US010837075B2

(12) United States Patent
Nakamura et al.

(10) Patent No.: US 10,837,075 B2
(45) **Date of Patent: *Nov. 17, 2020**

(54) HOT ROLLED AND ANNEALED FERRITIC STAINLESS STEEL SHEET, METHOD OF PRODUCING SAME, AND COLD ROLLED AND ANNEALED FERRITIC STAINLESS STEEL SHEET

(71) Applicant: JFE Steel Corporation, Tokyo (JP)

(72) Inventors: Tetsuyuki Nakamura, Tokyo (JP); Hiroki Ota, Tokyo (JP); Chikara Kami, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 333 days.

This patent is subject to a terminal disclaimer.

(21) Appl. No.: 15/115,726

(22) PCT Filed: Feb. 3, 2015

(86) PCT No.: PCT/JP2015/000466

§ 371 (c)(1),
(2) Date: Aug. 1, 2016

(87) PCT Pub. No.: WO2015/118855

PCT Pub. Date: Aug. 13, 2015

(65) Prior Publication Data

US 2017/0175217 A1 Jun. 22, 2017

(30) Foreign Application Priority Data

Feb. 5, 2014 (JP) ..... 2014-020541

(51) Int. Cl.

| | |
|---|---|
| ***C22C 38/00*** | (2006.01) |
| ***C22C 38/40*** | (2006.01) |
| ***C22C 38/46*** | (2006.01) |
| ***C22C 38/48*** | (2006.01) |
| ***C22C 38/52*** | (2006.01) |
| ***C21D 6/00*** | (2006.01) |
| ***C21D 8/02*** | (2006.01) |
| ***C21D 9/46*** | (2006.01) |

(Continued)

(52) U.S. Cl.

CPC ..... *C21D 9/46* (2013.01); *C21D 6/002* (2013.01); *C21D 8/02* (2013.01); *C21D 8/0226* (2013.01); *C21D 8/0236* (2013.01); *C21D 8/0263* (2013.01); *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *F01N 13/16* (2013.01); *C21D 2211/005* (2013.01); *F01N 2530/04* (2013.01)

(58) Field of Classification Search

CPC ..... C22C 38/04; C22C 38/001; C22C 38/06; C22C 38/48; C22C 38/46; C22C 38/44; C22C 38/004; C22C 38/42; C22C 38/50; C22C 38/54; C22C 38/002; C22C 38/52; C22C 38/00; C22C 38/005; C22C 38/26; C22C 38/20; C22C 38/28; C22C 38/22; C22C 38/24; C22C 38/30; C22C 38/32; C22C 38/40; C22C 38/18; C21D 6/002; C21D 6/004; C21D 6/005; C21D 6/008; C21D 8/0226; C21D 8/0263; C21D 8/0436; C21D 8/0236; C21D 8/0273; C21D 2211/005

See application file for complete search history.

(56) References Cited

U.S. PATENT DOCUMENTS

| | | | | |
|---|---|---|---|---|
| 6,113,710 | A | 9/2000 | Kato | |
| 10,000,824 | B2 * | 6/2018 | Yoshino | C21D 6/002 |

(Continued)

FOREIGN PATENT DOCUMENTS

| | | |
|---|---|---|
| CN | 101784686 | 7/2010 |
| CN | 103348023 | 11/2013 |

(Continued)

OTHER PUBLICATIONS

Machine translation of JP2013-209726A, 22 pages. (Year: 2013).*

(Continued)

*Primary Examiner* — Matthew E. Hoban
*Assistant Examiner* — Lynne Edmondson
(74) *Attorney, Agent, or Firm* — DLA Piper LLP (US)

(57) ABSTRACT

A hot rolled and annealed ferritic stainless steel sheet includes a composition that contains, on a mass percent basis, 0.015% or less of C, 1.00% or less of Si, 1.00% or less of Mn, 0.040% or less of P, 0.010% or less of S, 12.0% or more and 23.0% or less of Cr, 0.20% or more and 1.00% or less of Al, 0.020% or less of N, 1.00% or more and 2.00% or less of Cu, and 0.30% or more and 0.65% or less of Nb, Si and Al being contained so as to satisfy expression (1) described below, the balance being Fe and incidental impurities, and the hot rolled and annealed ferritic stainless steel sheet having a Vickers hardness less than 205, Si≥Al (1) (where in expression (1), Si represents the content of Si (% by mass), and Al represents the content of Al (% by mass)).

6 Claims, 1 Drawing Sheet

(51) Int. Cl.

| | |
|---|---|
| ***C22C 38/26*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/24*** | (2006.01) |
| ***C22C 38/28*** | (2006.01) |
| ***C22C 38/30*** | (2006.01) |
| ***C22C 38/32*** | (2006.01) |
| ***C22C 38/42*** | (2006.01) |
| ***C22C 38/50*** | (2006.01) |
| ***F01N 13/16*** | (2010.01) |
| ***C22C 38/22*** | (2006.01) |
| ***C22C 38/44*** | (2006.01) |

(56) References Cited

U.S. PATENT DOCUMENTS

| | | | | |
|---|---|---|---|---|
| 2004/0094240 | A1 | 5/2004 | Yazawa | |
| 2011/0061777 | A1 | 3/2011 | Ishii et al. | |
| 2013/0306204 | A1* | 11/2013 | Teraoka | C22C 38/54 148/603 |
| 2014/0023550 | A1 | 1/2014 | Hamada et al. | |
| 2015/0020933 | A1 | 1/2015 | Hamada et al. | |
| 2017/0275744 | A1 | 9/2017 | Ta | |
| 2017/0283923 | A1 | 10/2017 | Ta | |

FOREIGN PATENT DOCUMENTS

| | | | | | |
|---|---|---|---|---|---|
| EP | 2 182 085 | | | 5/2010 | |
| EP | 2 474 635 | | | 7/2012 | |
| JP | 2000-297355 | A | | 10/2000 | |
| JP | 2001-316773 | A | | 11/2001 | |
| JP | 2004-018921 | A | | 1/2004 | |
| JP | 2005-187857 | A | | 7/2005 | |
| JP | 2006-117985 | A | | 5/2006 | |
| JP | 2008-285693 | A | | 11/2008 | |
| JP | 2011-140709 | A | | 7/2011 | |
| JP | 2012-188748 | A | | 10/2012 | |
| JP | 2013-204059 | | | 10/2013 | |
| JP | 2013-209726 | A | | 10/2013 | |
| JP | 2013209726 | A | * | 10/2013 | C21D 9/46 |
| KR | 10-2013-0012975 | | | 2/2013 | |
| KR | 10-2014-0117586 | | | 10/2014 | |
| WO | 03/004714 | A1 | | 1/2003 | |

OTHER PUBLICATIONS

Korean Office Action dated Dec. 27, 2017, of corresponding Korean Application No. 10-2016-7020455, along with an English translation.

Korean Office Action dated May 29, 2017, of corresponding Korean Application No. 10-2016-7020455, along with a Concise Statement of Relevance of Office Action in English.

Chinese Office Action dated Feb. 28, 2017, of corresponding Chinese Application No. 201580007046.9, along with a Search Report in English.

Extended European Search Report dated Feb. 7, 2017, of corresponding European Application No. 15746068.4.

Chinese Office Action dated Feb. 8, 2018, of corresponding Chinese Application No. 201580007046.9, along with a Concise Statement of Relevance of Office Action in English.

Official Action dated Nov. 3, 2017, of related U.S. Appl. No. 15/112,901.

Official Action dated Aug. 9, 2018, of related U.S. Appl. No. 15/109,941.

* cited by examiner

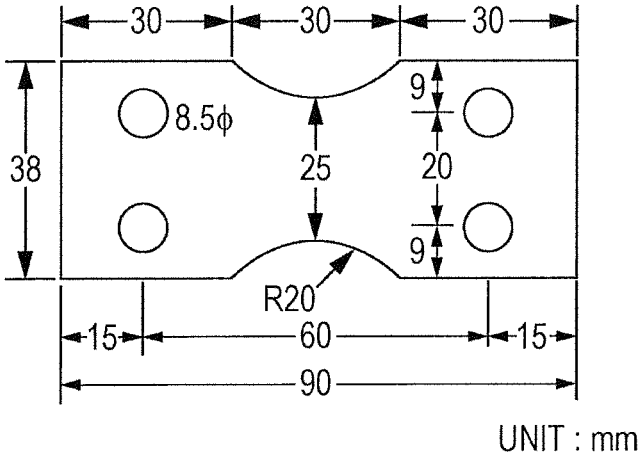
30
30
30
8.5ϕ
9
38
25
20
9
R20
15
60
15
90
UNIT : mm

HOT ROLLED AND ANNEALED FERRITIC STAINLESS STEEL SHEET, METHOD OF PRODUCING SAME, AND COLD ROLLED AND ANNEALED FERRITIC STAINLESS STEEL SHEET

TECHNICAL FIELD

This disclosure relates to Cr-containing steels, in particular, to a hot rolled and annealed ferritic stainless steel sheet having both good oxidation resistance and high-temperature fatigue resistance and suitably used for exhaust parts such as exhaust pipes and converter cases for automobiles and motorcycles and exhaust air ducts for thermal electric power plants, used at high temperatures; a method of producing the hot rolled and annealed ferritic stainless steel sheet; and a cold rolled and annealed ferritic stainless steel sheet produced by subjecting the hot rolled and annealed ferritic stainless steel sheet to cold rolling and annealing treatment.

BACKGROUND

Exhaust parts such as exhaust manifolds, exhaust pipes, converter cases for automobiles, used at high temperatures, are heated and cooled on start and stop of engine operation, respectively, so that the thermal expansion and contraction thereof are repeated. Also, the exhaust parts are restrained by the surrounding parts. Thus, thermal expansion and contraction thereof are limited and, as a result, thermal strain occurs in materials thereof, thereby causing thermal fatigue. Further, when engines are in operation, as exhaust parts are held at high temperatures, high-temperature fatigue is caused by vibrations. Thus, a material for each of the parts is required to have good oxidation resistance, good thermal fatigue resistance, and good high-temperature fatigue resistance (hereinafter, these three properties are collectively referred to as "heat resistance").

Currently, Cr-containing steels such as Type 429 (14% by mass of Cr-0.9% by mass of Si-0.4% by mass of Nb) containing Nb and Si, are widely used as materials for exhaust parts required to have heat resistance. However, improvement in engine performance is accompanied by an increase in exhaust gas temperature to a temperature higher than 900° C. In that case, Type 429 does not fully satisfy the properties required, in particular, thermal fatigue resistance and high temperature fatigue resistance.

To address the foregoing problems, materials such as a Cr-containing steel containing Mo in addition to Nb and having an improved high temperature proof stress, SUS444 (19% by mass of Cr-0.5% by mass of Nb-2% by mass Mo) specified in JIS G4305, and a ferritic stainless steel containing Nb, Mo, and W disclosed in Japanese Unexamined Patent Application Publication No. 2004-18921, have been developed. In particular, SUS444 and the ferritic stainless steel disclosed in JP '921 are excellent in properties such as heat resistance and corrosion resistance, and thus have been widely used as materials for exhaust parts used at high temperatures. However, recent sharp rise and volatility in price of rare metals such as Mo and W have demanded the development of a material produced from inexpensive raw materials and which has heat resistance comparable to that of a Cr-containing steel that contains Mo and W.

To cope with the demand, many techniques to improve the heat resistance of ferritic stainless steels without using expensive Mo or W have been reported.

For example, International Publication No. 2003/004714 discloses a ferritic stainless steel in which 0.50% by mass or less of Nb, 0.8% to 2.0% by mass of Cu, and 0.03% to 0.20% by mass of V are added to a steel containing 10% to 20% by mass of Cr, the ferritic stainless steel being used for parts of automobile exhaust gas flow passages. WO '714 states that the addition of V and Cu in combination improves high-temperature strength at 900° C. or lower, workability, and low-temperature toughness, which are comparable to those of a steel containing Nb and Mo.

Japanese Unexamined Patent Application Publication No. 2006-117985 discloses a ferritic stainless steel in which 0.05% to 0.30% by mass of Ti, 0.10% to 0.60% by mass of Nb, 0.8% to 2.0% by mass of Cu, and 0.0005% to 0.02% by mass of B are added to a steel containing 10% to 20% by mass of Cr, the ferritic stainless steel having a microstructure to have 10 precipitates or less of an ε-Cu phase (Cu precipitates) per 25 μm2, each of the Cu precipitates having a longer length of 0.5 μm or more. JP '985 states that when the ε-Cu phase presents in a specific state, as mentioned above, the thermal fatigue resistance of the ferritic stainless steel is improved.

Japanese Unexamined Patent Application Publication No. 2000-297355 discloses a ferritic stainless steel in which 1% to 3% by mass of Cu is added to a steel containing 15% to 25% by mass of Cr, the ferritic stainless steel being used for parts for exhaust parts of automobiles. JP '355 states that the addition of a predetermined amount of Cu results in precipitation strengthening due to Cu in a medium-temperature range (600° C. to 750° C.) and solid-solution strengthening due to Cu in a high-temperature range, thereby improving the thermal fatigue resistance of the ferritic stainless steel.

Each of the techniques disclosed in WO '714, JP '985 and JP '355 has a characteristic that the addition of Cu improves the thermal fatigue resistance of a corresponding one of the ferritic stainless steels. The addition of Cu improves the thermal fatigue resistance of the ferritic stainless steel but significantly deteriorates the oxidation resistance. Specifically, when an attempt is made to improve the heat resistance of each ferritic stainless steel by the addition of Cu, although the thermal fatigue resistance is improved, the oxidation resistance of the steel itself is deteriorated, thereby comprehensively deteriorating the heat resistance.

Techniques to improve the heat resistance of ferritic stainless steels by the intentional addition of Al are reported.

For example, Japanese Unexamined Patent Application Publication No. 2008-285693 discloses a ferritic stainless steel in which 0.2% to 2.5% by mass of Al, which is a solid-solution strengthening element, more than 0.5% to 1.0% by mass of Nb, and 3×([% C]+[% N]) to 0.25% by mass of Ti (where [% C] and [% N] are each represent the C content and the N content, respectively, expressed in units of % by mass) are added to a steel containing 13% to 25% by mass of Cr, the ferritic stainless steel being used for exhaust parts of automobiles. JP '693 states that the addition of predetermined amounts of Al, Nb, and Ti improves the thermal fatigue resistance of the ferritic stainless steel.

Japanese Unexamined Patent Application Publication No. 2001-316773 discloses a heat-resistant ferritic stainless steel for a catalyst support in which 0.1% to 2% by mass of Si, 1% to 2.5% by mass of Al, and 3×(C+N) to 20×(C+N) of Ti (% by mass) are added to a steel containing 10% to 25% by mass of Cr, wherein Si and Al are added such that Al+0.5×Si meets 1.5% to 2.8% by mass. JP '773 states that addition of predetermined amounts of Si, Al, and Ti enables an oxide film mainly composed of $Al_2O_3$ having high barrier properties to be formed at the interface between a catalyst layer and a base material in an engine exhaust gas atmosphere, thereby improving the oxidation resistance of the ferritic stainless steel.

Japanese Unexamined Patent Application Publication No. 2005-187857 discloses a Cr-containing ferritic steel in which one or two or more of Ti, Nb, V, and Al are added to a steel containing 6% to 20% by mass of Cr in a total amount of 1% by mass or less. JP '857 states that addition of Al and so forth fixes C, N as a carbonitride in the steel, thereby improving formability of the Cr-containing ferritic steel.

However, in the technique disclosed in JP '693 among the techniques including the intentional addition of Al, the Si content in steel is low. Thus, even in the intentional addition of Al, Al is preferentially formed into an oxide or nitride and, as a result, the amount of Al in solid solute is reduced, thereby failing to give desired high-temperature strength to the ferritic stainless steel.

In the technique disclosed in JP '773, a large amount, 1% by mass or more, of Al is added. Thus, workability of the ferritic stainless steel at room temperature is significantly deteriorated. Furthermore, Al is easily combined with O (oxygen), thus deteriorating the oxidation resistance. In the technique disclosed in JP '857, although the ferritic stainless steel having good formability is provided, the amount of Cu or Al added is small, or none of Cu or Al is added. Hence, good heat resistance is not provided.

As described above, when an attempt is made to improve the high-temperature strength and the oxidation resistance of a ferritic stainless steel by the addition of Al, the intentional addition of Al alone does not sufficiently provide the effects. In the addition of Cu and Al in combination, the addition of small amounts of those elements does not provide good heat resistance.

To overcome the foregoing, we developed a ferritic stainless steel in which 0.4% to 1.0% by mass of Si, 0.2% to 1.0% by mass of Al, 0.3% to 0.65% by mass of Nb, and 1.0% to 2.5% by mass of Cu are added to a steel containing 16% to 23% by mass of Cr disclosed in Japanese Unexamined Patent Application Publication No. 2011-140709, wherein Si and Al are added to satisfy Si≥Al. In that steel, incorporation of predetermined amounts of Nb and Cu in combination increases the high-temperature strength in a wide temperature range to improve thermal fatigue resistance. Although containing Cu is liable to deteriorate oxidation resistance, containing an appropriate amount of Al prevents this deterioration in oxidation resistance. Containing an appropriate amount of Al also improves the thermal fatigue resistance even in the specific temperature range in which containing Cu does not improve the thermal fatigue resistance.

Furthermore, optimization of the ratio of the Si content to the Al content improves the high temperature fatigue resistance.

Reductions in weight and exhaust back pressure of exhaust parts are required and, to this end, a further reduction in thickness and formation into a complex form have been studied. When a thinned sheet is subjected to severe working, the thickness of the sheet can be significantly reduced. A portion having a reduced thickness is liable to crack because of high-temperature fatigue. Thus, a crack can be formed in the portion having a thickness reduced by severe working in low temperature rather than a portion of the sheet in the maximum temperature. For this reason, steel materials used for exhaust parts have been required to have good high-temperature fatigue resistance in an intermediate temperature range (about 700° C.) as well as at the maximum temperature. The steel disclosed in JP '709, however, was developed by studying high-temperature fatigue resistance only at 850° C. Thus, there is room to investigate the high-temperature fatigue resistance at about 700° C.

It could therefore be helpful to provide a hot rolled and annealed ferritic stainless steel sheet having good oxidation resistance and good high-temperature fatigue resistance at about 700° C., a method of producing the hot rolled and annealed ferritic stainless steel sheet, and a cold rolled and annealed ferritic stainless steel sheet produced by subjecting the hot rolled and annealed ferritic stainless steel sheet to cold rolling and annealing treatment.

SUMMARY

We thus provide:

[1] A hot rolled and annealed ferritic stainless steel sheet has a composition that contains, on a mass percent basis, 0.015% or less of C, 1.00% or less of Si, 1.00% or less of Mn, 0.040% or less of P, 0.010% or less of S, 12.0% or more and 23.0% or less of Cr, 0.20% or more and 1.00% or less of Al, 0.020% or less of N, 1.00% or more and 2.00% or less of Cu, and 0.30% or more and 0.65% or less of Nb, Si and Al being contained to satisfy expression (1):

$$Si \geq Al \quad (1)$$

(where in expression (1), Si represents the content of Si (% by mass), and Al represents the content of Al (% by mass)), the balance being Fe and incidental impurities, and the hot rolled and annealed ferritic stainless steel sheet has a Vickers hardness less than 205.

[2] The hot rolled and annealed ferritic stainless steel sheet described in item [1] further contains, on a mass percent basis, one or two or more selected from 0.50% or less of Ni, 1.00% or less of Mo, and 0.50% or less of Co, in addition to the composition.

[3] The hot rolled and annealed ferritic stainless steel sheet described in item [1] or [2] further contains, on a mass percent basis, one or two or more selected from 0.50% or less of Ti, 0.50% or less of Zr, 0.50% or less of V, 0.0030% or less of B, 0.08% or less of REM, 0.0050% or less of Ca, and 0.0050% or less of Mg, in addition to the composition.

[4] A cold rolled and annealed ferritic stainless steel sheet is produced by subjecting the hot rolled and annealed ferritic stainless steel sheet described in any one of items [1] to [3] to cold rolling and annealing treatment.

[5] A method of producing the hot rolled and annealed ferritic stainless steel sheet described in any one of items [1] to [4] includes subjecting a steel slab to hot rolling and hot rolled steel sheet annealing in that order, in which in the hot rolling, a coiling temperature is lower than 600° C.

It is possible to provide a hot rolled and annealed ferritic stainless steel sheet having good oxidation resistance and good high-temperature fatigue resistance and suitable for exhaust parts for automobiles and so forth, a method of producing the hot rolled and annealed ferritic stainless steel sheet, and a cold rolled and annealed ferritic stainless steel sheet produced by subjecting the hot rolled and annealed ferritic stainless steel sheet to cold rolling and annealing treatment. In particular, the ferritic stainless steel sheet having good high-temperature fatigue resistance in a wide temperature range is provided and thus can broaden applications of ferritic stainless steels, which provides industrially marked effects.

BRIEF DESCRIPTION OF THE DRAWING

FIG. 1 illustrates the shape of a specimen for a high-temperature fatigue test in examples.

DETAILED DESCRIPTION

Regarding the ferritic stainless steel disclosed in JP '709, i.e., the ferritic stainless steel containing Cu, Al, and Nb and having improved heat resistance, we conducted studies to improve the high-temperature fatigue resistance at the maximum temperature (850° C.) and in an intermediate temperature range (about 700° C.) in assumed operating temperatures (between room temperature and 850° C.) when the steel is used for exhaust parts.

We observed microstructures of ferritic stainless steel sheets (hot rolled and annealed steel sheets) produced by subjecting a ferritic stainless steel material containing Cu, Al, and Nb to hot rolling and hot rolled steel sheet annealing under various conditions and a ferritic stainless steel sheets (cold rolled and annealed steel sheets) produced by, subsequent to the hot rolled steel sheet annealing, pickling, cold rolling, cold rolled steel sheet annealing, and pickling. Next, the ferritic stainless steel sheets (the hot rolled and annealed steel sheets and the cold rolled and annealed steel sheets) were heated to 700° C. and subjected to a high temperature fatigue test.

The results demonstrated that a microstructure in which the precipitation of s-Cu is inhibited provides good high-temperature fatigue resistance at about 700° C. Furthermore, we found that in the hot rolling step, controlling the coiling temperature enables precipitation of s-Cu to be inhibited in the hot rolled and annealed steel sheets and the cold rolled and annealed steel sheets.

The results demonstrated that there is a correlation between the amount of ε-Cu precipitated and the hardness of each of the ferritic stainless steel sheets and that an increase in the amount of ε-Cu precipitated increases the hardness of each of the ferritic stainless steel sheets. Instead of the quantification of the amount of ε-Cu precipitated, the hardness was measured in the hot rolled and annealed steel sheets and the high-temperature fatigue resistance at 700° C. The results demonstrated that when the coiling temperature is controlled such that the hot rolled and annealed steel sheets each have a Vickers hardness less than 205, the amount of ε-Cu precipitated is reduced to provide the ferritic stainless steel sheets each having good high-temperature fatigue resistance at about 700° C.

As described above, we found that the addition of predetermined amounts of Cu, Al, and Nb and the optimization of a heat history after hot rolling to control the precipitation of ε-Cu provides a steel having good high-temperature fatigue resistance not only at the maximum temperature (850° C.) and but also in an intermediate-temperature range (about 700° C.) in assumed operating temperatures (between room temperature and 850° C.) when the steel is used for exhaust parts.

Our hot rolled and annealed ferritic stainless steel sheet has a composition that contains, on a mass percent basis, 0.015% or less of C, 1.00% or less of Si, 1.00% or less of Mn, 0.040% or less of P, 0.010% or less of S, 12.0% or more and 23.0% or less of Cr, 0.20% or more and 1.00% or less of Al, 0.020% or less of N, 1.00% or more and 2.00% or less of Cu, and 0.30% or more and 0.65% or less of Nb, Si and Al being contained to satisfy expression (1), i.e., Si≥Al (where in the expression, Si represents the content of Si (% by mass), and Al represents the content of Al (% by mass)), the balance being Fe and incidental impurities, and the hot rolled and annealed ferritic stainless steel sheet has a Vickers hardness less than 205.

A cold rolled and annealed ferritic stainless steel sheet is produced by subjecting the hot rolled and annealed ferritic stainless steel sheet to cold rolling and annealing treatment.

Reasons for limiting contents of components of the hot rolled and annealed ferritic stainless steel sheet will be described below. Note that % used for the content of each component represents % by mass unless otherwise specified.

C: 0.015% or Less

C is an element effective in increasing the strength of steel. However, a content of C more than 0.015% results in a significant deterioration in the toughness and formability of steel. Thus, the content of C is 0.015% or less. From the viewpoint of ensuring the formability of steel, the content of C is preferably 0.008% or less. From the viewpoint of ensuring strength required for exhaust parts, the content of C is preferably 0.001% or more. More preferably, the content of C is 0.003% or more.

Si: 1.00% or Less

Si is an element that improves the oxidation resistance of steel and an important element to effectively utilize the solid-solution strengthening with Al as described below. The content of Si is preferably 0.02% or more to provide the desired effect. An excessive content of Si more than 1.00% results in deterioration in the workability of steel. Thus, the content of Si is 1.00% or less. Si is also an element effective in improving the oxidation resistance of steel in a water vapor atmosphere. When the oxidation resistance in the water vapor atmosphere is required, the content of Si is preferably 0.40% or more. More preferably, the content of Si is 0.60% or more and 0.90% or less.

Mn: 1.00% or Less

Mn is an element added as a deoxidizing agent and to increase the strength of steel. Mn also has the effect of improving the oxidation resistance by inhibiting the separation of oxide scales (spalling of oxide scales). The content of Mn is preferably 0.02% or more to provide the desired effect. However, an excessive content of Mn more than 1.00% is liable to lead to formation of a γ-phase at a high temperature, thereby deteriorating the heat resistance of steel. Thus, the content of Mn is 1.00% or less. The content of Mn is preferably 0.05% or more and 0.80% or less and more preferably 0.10% or more and 0.50% or less.

P: 0.040% or Less

P is a harmful element that deteriorates the toughness of steel and is preferably minimized. Thus, the content of P is 0.040% or less. The content of P is preferably 0.030% or less.

S: 0.010% or Less

S is a harmful element that adversely affects formability by reducing elongation and the r-value of steel and deteriorates the corrosion resistance. Thus, the content of S is desirably minimized. The content of S is 0.010% or less and preferably 0.005% or less.

Cr: 12.0% or More and 23.0% or Less

Cr is an important element effective in improving the corrosion resistance and oxidation resistance. Sufficient oxidation resistance is not obtained with a content of Cr less than 12.0%. Cr is also an element that increases the hardness of steel so that decreases the ductility of steel by solid-solution strengthening at room temperature. In particular, a content of Cr more than 23.0% leads to significant disadvantages due to the increase in hardness and the decrease in ductility. Thus, the content of Cr is 12.0% or more and 23.0% or less. The content of Cr is preferably 14.0% or more and 20.0% or less.

Al: 0.20% or More and 1.00% or Less

Al is an essential element to improve the oxidation resistance of a Cu-containing steel. Al is also an element dissolved in steel and strengthens the steel by solid-solution strengthening. In particular, Al has the heat-resistance-improving effect by increasing the high-temperature strength at a temperature higher than 800° C. and thus is an important element. In particular, to provide good oxidation resistance, the content of Al needs to be 0.20% or more. On the other hand, a content of Al more than 1.00% leads to an increase in the hardness of steel, thereby deteriorating the workability. Thus, the content of Al is 0.20% or more and 1.00% or less. The content of Al is preferably 0.25% or more and 0.80% or less and more preferably 0.30% or more and 0.60% or less.

Si and Al are contained to satisfy expression (1) described below. In expression (1), Si represents the content of Si (% by mass), and Al represents the content of Al (% by mass).

$$Si \geq Al \quad (1)$$

As described above, Al is an element having the ability for solid-solution strengthening at a high temperature and thereby increasing the high-temperature strength of steel. However, when the content of Al of steel is higher than the content of Si, Al preferentially forms an oxide and a nitride at a high temperature and the amount of Al dissolved is reduced, thereby failing to contribute sufficiently to solid-solution strengthening. In contrast, when the content of Si of steel is equal to or higher than the content of Al, Si is preferentially oxidized and forms a dense oxide layer on a surface of a steel sheet continuously. This oxide layer has the effect of inhibiting the diffusion of oxygen and nitrogen from the outside into the inside. Formation of the oxide layer minimizes the oxidation and nitridation, in particular, nitridation, of Al, thereby ensuring a sufficient amount of Al dissolved. As a result, the thermal fatigue resistance and high-temperature fatigue resistance are improved considerably due to the increase of high-temperature strength of steel caused by the solid-solution strengthening with Al. For this reason, Si and Al are contained to satisfy Si (% by mass)≥Al (% by mass).

N: 0.020% or Less

N is an element that deteriorates the toughness and formability of steel. At a content of N more than 0.020%, these phenomena seem significantly. Thus, the content of N is 0.020% or less. From the viewpoint of ensuring the toughness and formability of steel, the content of N is desirably minimized. The content of N is preferably less than 0.015% and more preferably 0.010% or less. However, an excessive reduction in the content of N increases the production cost of a steel material because such denitrification requires a long time. Thus, in view of both cost and formability, the content of N is preferably 0.004% or more.

Cu: 1.00% or More and 2.00% or Less

Cu is an element significantly effective in improving the thermal fatigue resistance and high-temperature fatigue resistance because the high-temperature strength of steel is increased by the precipitation strengthening with ε-Cu. To provide the effects, the content of Cu needs to be 1.00% or more. However, at a content of Cu more than 2.00%, even if a coiling temperature in the hot rolling step is controlled, ε-Cu is precipitated in a hot rolled and annealed sheet, thereby failing to provide good high-temperature fatigue resistance at 700° C. For this reason, the content of Cu is 1.00% or more and 2.00% or less. The content of Cu is preferably 1.10% or more and 1.60% or less.

Nb: 0.30% or More and 0.65% or Less

Nb is an element that improves corrosion resistance and formability of steel and the intergranular corrosion resistance in a weld zone due to fixing C and N in steel by forming a carbonitride, and improves the thermal fatigue resistance by increasing the high-temperature strength. These effects are provided at a content of Nb of 0.30% or more. However, a content of Nb more than 0.65% promotes embrittlement of steel by formatting precipitation of a Laves phase. Thus, the content of Nb is 0.30% or more and 0.65% or less. The content of Nb is preferably 0.35% or more and 0.55% or less. In particular, when the toughness of steel is required, the content of Nb is preferably 0.40% or more and 0.49% or less and more preferably 0.40% or more and 0.47% or less.

The basic components of the ferritic stainless steel have been described above. If necessary, one or two or more selected from Ni, Mo, and Co may be further contained in ranges described below, in addition to the foregoing basic components.

Ni: 0.50% or Less

Ni is an element that improves the toughness of steel. Ni also has the effect of improving the oxidation resistance of steel. To provide the effects, the content of Ni is preferably 0.05% or more. Ni is a strong γ-phase formation element (austenite phase formation element). Thus, a content of Ni more than 0.50% can deteriorate the oxidation resistance and the thermal fatigue resistance by formation of the γ-phase at a high temperature. Accordingly, when Ni is contained, the content of Ni is preferably 0.50% or less. The content of Ni is more preferably 0.10% or more and 0.40% or less.

Mo: 1.00% or Less

Mo is an element having the effect of improving the thermal fatigue resistance and the high-temperature fatigue resistance by increasing the high-temperature strength of steel. The content of Mo is preferably 0.05% or more to provide the desired effect. In an Al-containing steel as herein, a content of Mo more than 1.00% can result in a deterioration in oxidation resistance. Thus, when Mo is contained, the content of Mo is preferably 1.00% or less. The content of Mo is more preferably 0.60% or less.

Co: 0.50% or Less

Co is an element effective in improving the toughness of steel. Co also has the effect of improving the thermal fatigue resistance by reducing the thermal expansion coefficient of steel. The content of Co is preferably 0.005% or more to provide the desired effect. However, Co is an expensive element. In addition, if the content of Co is more than 0.50%, the effects are saturated. Accordingly, when Co is contained, the content of Co is preferably 0.50% or less. The content of Co is more preferably 0.01% or more and 0.20% or less. When good toughness is required, the content of Co is preferably 0.02% or more and 0.20% or less.

The ferritic stainless steel may further contain one or two or more selected from Ti, Zr, V, B, REM, Ca, and Mg in ranges described below, as needed.

Ti: 0.50% or Less

As with Nb, Ti is an element that fixes C and N in steel, thus improving the corrosion resistance and formability, and prevents intergranular corrosion in a weld zone. Furthermore, Ti is an element effective in improving the oxidation resistance of the Al-containing steel. The content of Ti is preferably 0.01% or more to provide the desired effect. However, an excessive content of Ti more than 0.50% leads to formation of a coarse nitride to deteriorate the toughness of steel. Deterioration in the toughness of steel adversely affects productivity. For example, a steel sheet is broken by bending and straightening cycles on a hot rolled steel sheet annealing line. Accordingly, when Ti is contained, the content of Ti is preferably 0.50% or less. The content of Ti is more preferably 0.30% or less and still more preferably 0.25% or less.

Zr: 0.50% or Less

Zr is an element that improves the oxidation resistance of steel. The content of Zr is preferably 0.005% or more to provide the desired effect. However, a content of Zr more than 0.50% makes steel embrittle by precipitating of an intermetallic compound of Zr. Thus, when Zr is contained, the content of Zr is preferably 0.50% or less. The content of Zr is more preferably 0.20% or less.

V: 0.50% or Less

V is an element effective in improving both the workability and oxidation resistance of steel. The effects are significantly provided when the content of V is 0.01% or more. An excessive content of V more than 0.50% leads to precipitation of coarse V(C, N), thereby degrading the surface properties of steel. Thus, when V is contained, the content of V is preferably 0.01% or more and 0.50% or less. The content of V is more preferably 0.05% or more and 0.40% or less and still more preferably 0.05% or more and less than 0.20%.

B: 0.0030% or Less

B is an element effective in improving the workability, in particular, secondary workability, of steel. To provide the effect, the content of B is preferably 0.0005% or more. An excessive content of B more than 0.0030% decreases the workability of steel by forming BN. Thus, when B is contained, the content of B is preferably 0.0030% or less. The content of B is more preferably 0.0010% or more and 0.0030% or less.

REM: 0.08% or Less

As with Zr, a rare-earth element (REM) is an element that improves the oxidation resistance of steel. To provide the effect of the REM, the content of the REM is preferably 0.01% or more. A content of the REM more than 0.08% results in the embrittlement of steel. Thus, when the REM is contained, the content of the REM is preferably 0.08% or less. The content of the REM is more preferably 0.04% or less.

Ca: 0.0050% or Less

Ca is a component effective in preventing nozzle clogging that is liable to occur during continuous casting due to precipitation of Ti-based inclusions. To provide the effect, the content of Ca is preferably 0.0005% or more. To provide good surface properties without causing surface defects of steel, the content of Ca needs to be 0.0050% or less. Thus, when Ca is contained, the content of Ca is preferably 0.0050% or less. The content of Ca is more preferably 0.0005% or more and 0.0020% or less and still more preferably 0.0005% or more and 0.0015% or less.

Mg: 0.0050% or Less

Mg is an element effective in improving the workability and toughness of steel by increasing the equiaxed crystal ratio of a slab. Furthermore, Mg is an element effective in inhibiting the coarsening of carbonitrides of Nb and Ti. When a carbonitride of Ti is coarsened, it serves as a starting point for brittle cracking, thereby deteriorating the toughness of steel. Also, when a carbonitride of Nb is coarsened, the amount of solid-solute Nb in steel is reduced, thereby leading to a deterioration in thermal fatigue resistance. Mg is an element effective in solving these problems. The content of Mg is preferably 0.0010% or more. A content of Mg more than 0.0050% leads to degradation in the surface properties of steel. Thus, when Mg is contained, the content of Mg is preferably 0.0050% or less. The content of Mg is more preferably 0.0010% or more and 0.0025% or less.

Elements (balance) other than those described above contained in the hot rolled and annealed ferritic stainless steel sheet are Fe and incidental impurities.

The hot rolled and annealed ferritic stainless steel sheet has features of having the composition specified as described above and having a Vickers hardness less than 205 due to the microstructure in which the amount of ε-Cu precipitated in the hot rolled and annealed steel sheet is minimized.

Vickers hardness of hot rolled and annealed steel sheet: less than 205

Cu has the effect of strengthening steel by precipitation strengthening with ε-Cu to improve the thermal fatigue resistance and the high-temperature fatigue resistance. However, when steel is used for a long period of time at a temperature (about 700° C.) at which ε-Cu is easily precipitated, the high-temperature fatigue resistance is significantly based on the initial precipitation state of ε-Cu, i.e., the precipitation state of ε-Cu before heating to the temperature.

When ε-Cu is precipitated in steel in the initial state, when it is started to use at 700° C., the ε-Cu precipitates serve as nuclei so that coarse ε-Cu is precipitated, thereby failing to provide a precipitation strengthening effect. When ε-Cu is not precipitated in steel in the initial state, after starting to use at 700° C., fine ε-Cu is precipitated, thereby providing the strengthening effect. Furthermore, the fine precipitation allows the coarsening to proceed very slowly, thereby providing the precipitation strengthening effect over a longer period of time. For this reason, the minimization of the amount of ε-Cu precipitated in steel in the initial state significantly improves the high-temperature fatigue resistance at a temperature (about 700° C.) at which ε-Cu is readily precipitated.

The ferritic stainless steel sheet used as a material for exhaust parts is typically produced by subjecting a steel material such as a slab, to hot rolling to form a hot rolled steel sheet and subjecting the hot rolled steel sheet to annealing treatment (hot rolled steel sheet annealing) to form a hot rolled and annealed steel sheet or by, subsequent to the annealing treatment (hot rolled steel sheet annealing), subjecting the hot rolled and annealed steel sheet to pickling, subjecting the hot rolled and annealed steel sheet to cold rolling to form a cold rolled steel sheet, and subjecting the cold rolled steel sheet to annealing treatment (cold rolled steel sheet annealing) and pickling to form a cold rolled and annealed steel sheet. Thus, to ensure sufficient high-temperature fatigue resistance at a temperature (about 700° C.) at which ε-Cu is easily precipitated, it is necessary to minimize the amount of ε-Cu precipitated in the final product sheet, i.e., the hot rolled and annealed steel sheet or the cold rolled and annealed steel sheet.

As a method of reducing the amount of ε-Cu precipitated in the hot rolled and annealed steel sheet, a method of dissolving ε-Cu in steel by the annealing of a hot rolled steel sheet (hot rolled steel sheet annealing) is conceivable. However, our results revealed that in the hot rolled steel sheet annealing, when ε-Cu is coarsely precipitated in a steel sheet or where a large amount of fine ε-Cu is precipitated before annealing, ε-Cu is not always sufficiently dissolved by the annealing treatment because the length of time that the steel sheet is held in a high-temperature range is short. The results also demonstrates that in the hot rolled steel sheet before the annealing treatment, in the case where the amount of ε-Cu precipitated is sufficiently reduced, ε-Cu is negligibly precipitated in the subsequent steps.

When the cold rolled and annealed steel sheet is the final product sheet, a method of dissolving ε-Cu in steel by the annealing of the cold rolled steel sheet (cold rolled steel sheet annealing) is conceived. However, also in the cold rolled steel sheet annealing, when ε-Cu is coarsely precipitated in a steel sheet or where a large amount of fine ε-Cu is precipitated before annealing, ε-Cu is not always sufficiently dissolved by the annealing treatment because the length of time that the steel sheet is held in a high-temperature range is short. We conducted careful studies on the high-temperature fatigue resistance of the cold rolled and annealed steel sheet and found that the high temperature fatigue resistance of the cold rolled and annealed steel sheet at about 700° C. tends to depend on the amount of ε-Cu precipitated in the hot rolled and annealed steel sheet serving as a material.

We also confirmed that there is a correlation between the amount of ε-Cu precipitated in steel and the hardness properties of the steel and that the hardness increases as the amount of ε-Cu precipitated increases. Our results revealed that when the amount of ε-Cu precipitated is controlled such that the hot rolled and annealed steel sheet has a Vickers hardness less than 205, the high-temperature fatigue resistance is sufficiently provided at a temperature (about 700° C.) at which ε-Cu is easily precipitated. Our results also revealed that when the amount of ε-Cu precipitated is controlled such that the hot rolled and annealed steel sheet has a Vickers hardness less than 205, the cold rolled and annealed steel sheet produced from the hot rolled and annealed steel sheet serving as a mother sheet also has good high-temperature fatigue resistance at a temperature (about 700° C.) at which ε-Cu is easily precipitated.

For the foregoing reasons, the hot rolled and annealed ferritic stainless steel sheet has a Vickers hardness less than 205 and preferably less than 195. The Vickers hardness may be measured according to JIS Z2244.

Preferred methods of producing the hot rolled and annealed ferritic stainless steel sheet and the cold rolled and annealed ferritic stainless steel sheet will be described below.

For the hot rolled and annealed ferritic stainless steel sheet and the cold rolled and annealed ferritic stainless steel sheet, basically, an usual method of producing a ferritic stainless steel sheet may be suitably employed. For example, a molten steel is made in a known melting furnace, for example, a converter or an electric furnace, and then, optionally, subjected to secondary refining, for example, ladle refining or vacuum refining, to produce a steel having the foregoing composition. Subsequently, a slab is formed by continuous casting or ingot casting-slabbing. Thereafter, the slab is subjected to, for example, hot rolling, hot rolled steel sheet annealing, and pickling or surface polishing, in that order, to form a hot rolled and annealed steel sheet. For the cold rolled and annealed ferritic stainless steel sheet, the hot rolled and annealed steel sheet obtained by the above is subjected to, for example, cold rolling, cold rolled steel sheet annealing, and pickling, in that order, to form a cold rolled and annealed steel sheet. However, only the coiling temperature of the hot-rolled steel sheet after the hot rolling (before the hot rolled steel sheet annealing) needs to be specified as described below.

Coiling temperature of hot rolled steel sheet: lower than 600° C.

The steel contains 1.00% or more of Cu to improve the thermal fatigue resistance and high-temperature fatigue resistance. As described above, to improve the high-temperature fatigue resistance of the steel containing 1.00% or more of Cu when the steel is used at a temperature range (about 700° C.) at which ε-Cu is easily precipitated and coarsened, it is important to inhibit the initial precipitation of ε-Cu.

In the production process of the steel sheet, a large amount of ε-Cu is precipitated or coarsened when a hot-rolled steel sheet is coiled. Precipitation of ε-Cu is minimized when the hot rolled steel sheet is coiled at a coiling temperature lower than 600° C. Even if ε-Cu is precipitated, the amount precipitated is small. Thus, by holding the resulting coil at a high temperature during the subsequent hot rolled steel sheet annealing, ε-Cu is dissolved in the steel. That is, when the hot rolled steel sheet is coiled at a coiling temperature lower than 600° C., it is possible to prevent the precipitation of ε-Cu during the coiling of the hot rolled steel sheet. Even if ε-Cu is precipitated, the amount of ε-Cu precipitated is controlled to the extent that ε-Cu is dissolved in the steel by the subsequent hot rolled annealing. This significantly improves the high-temperature fatigue resistance of the final product sheet at about 700° C. The amount of ε-Cu precipitated after the coiling of the hot rolled steel sheet may be determined by measuring the hardness of the hot rolled and annealed steel sheet. As described above, the hot rolled and annealed steel sheet is required to have a Vickers hardness less than 205.

When the coiling temperature of the hot rolled steel sheet is 600° C. or higher, the amount of ε-Cu precipitated during coiling is increased. In addition, coarsening of the ε-Cu precipitated proceeds. If the hot rolled steel sheet annealing is then performed, the ε-Cu is not sufficiently dissolved in the steel. Thus, the hot rolled and annealed steel sheet has a Vickers hardness of 205 or more. Furthermore, the hot rolled and annealed steel sheet does not have good high-temperature fatigue resistance at 700° C.

For this reason, the coiling temperature of the hot rolled steel sheet is lower than 600° C. This provides the hot rolled and annealed steel sheet having only very few amount of ε-Cu precipitated and having a Vickers hardness less than 205. The coiling temperature of the hot rolled steel sheet is preferably lower than 580° C. and more preferably 550° C. or lower.

The following production conditions other than the coiling temperature of the hot rolled steel sheet are preferred to produce the hot rolled and annealed ferritic stainless steel sheet and the cold rolled and annealed ferritic stainless steel sheet.

A steel-making process of producing a molten steel preferably includes subjecting steel melted in, for example, a converter or an electric furnace to secondary refining by a VOD method or the like to provide a steel containing the foregoing essential components and an optionally added component. The resulting molten steel may be formed into a steel material by a known method. A continuous casting method is preferably employed in view of productivity and quality. Then, the steel material is preferably heated to a temperature of 1000° C. or higher and 1250° C. or lower and subjected to hot rolling to form a hot rolled steel sheet having a desired thickness. The thickness of the hot rolled steel sheet is not particularly limited and is preferably about 4 mm or more and 6 mm or less.

As described above, the coiling temperature of the hot rolled steel sheet (temperature at which a hot-rolled coil is formed by coiling) is lower than 600° C., preferably lower than 580° C., and more preferably 550° C. or lower. While the method in which the hot rolled steel sheet is produced by the hot rolling has been described above, naturally, a form other than the sheet may be produced by hot working.

Preferably, the resulting hot rolled steel sheet obtained as described above is then subjected to hot rolled steel sheet annealing in which continuous annealing is performed at an annealing temperature of 900° C. or higher and 1100° C. or lower, followed by pickling or polishing for descaling to provide a hot rolled and annealed steel sheet. The descaling may be performed by shot blasting before the pickling, as needed.

After the hot rolled steel sheet annealing, cooling may be performed. In the cooling, conditions such as a cooling rate are not particularly limited.

The resulting hot rolled and annealed steel sheet as described above may be used as the final product sheet. The cold rolled and annealed steel sheet may be used as the final product sheet, the cold rolled and annealed steel sheet being produced by subjecting the hot rolled and annealed steel sheet to cold rolling to provide a cold rolled steel sheet, followed by cold rolled steel sheet annealing (finishing annealing), pickling and so forth.

The cold rolling may be performed once or twice or more with intermediate annealing performed therebetween. Each of the steps of the cold rolling, the finishing annealing, and the pickling may be repeated. When the steel sheet is required to have a surface gloss and a controlled roughness, skin pass rolling may be performed after the cold rolling or the finishing annealing. When the steel sheet is required to have a better surface gloss, bright annealing (BA) may be performed.

The cold rolling may be performed once. The cold rolling may be performed twice or more with the intermediate annealing performed therebetween in view of productivity and required quality. In the cold rolling performed once or twice or more, the total rolling reduction is preferably 60% or more and more preferably 70% or more. The cold rolled steel sheet produced by the cold rolling is then subjected to continuous annealing (finishing annealing) at a temperature of preferably 900° C. or higher and 1150° C. or lower and more preferably 950° C. or higher and 1120° C. or lower and pickling to provide a cold rolled and annealed steel sheet. The thickness of the cold rolled and annealed steel sheet is not particularly limited and is preferably about 1 mm or more and 3 mm or less.

As with the hot rolled steel sheet annealing, after the cold rolled steel sheet annealing (after the intermediate annealing and the finishing annealing), cooling may be performed. In the cooling, conditions such as a cooling rate are not particularly limited.

After finishing annealing, form, surface roughness, and material quality of the cold rolled and annealed steel sheet may be adjusted by, for example, skin pass rolling to provide the final product sheet, depending on the intended use.

The resulting final product sheet (the hot rolled and annealed steel sheet or the cold rolled and annealed steel sheet) is then subjected to, for example, cutting, bending work, stretch work, or drawing work, depending on the intended use, to form, for example, exhaust pipes and catalyst cases of automobiles and motorcycles, exhaust ducts of thermal electric power plants, and fuel cell-related members such as separators, interconnectors, and reformers. A method of welding these parts is not particularly limited. Examples of the method that may be employed include typical arc welding methods such as metal inert gas (MIG), metal active gas (MAG), and tungsten inert gas (TIG) arc welding methods; resistance welding methods such as spot welding and seam welding methods; and electric resistance welding methods such as high-frequency resistance welding and high-frequency induction welding methods.

EXAMPLES

Steels were melted in a vacuum melting furnace and cast into steel ingots (50 kg) having chemical compositions listed in Table 1. Each of the steel ingots was forged and divided into two pieces.

One of the two divided pieces was heated to 1170° C. for 1 hour and then hot-rolled into a hot rolled steel sheet having a thickness of 5 mm. The resulting hot rolled steel sheet was held at a simulated coiling temperature of 450° C. to 700° C. for 1 hour and cooled to room temperature. Then, the hot rolled steel sheet was subjected to hot rolled steel sheet annealing in which soaking was performed at 1030° C. for 60 seconds, thereby providing a hot rolled and annealed steel sheet.

The Vickers hardness was measured on a section of the hot rolled and annealed steel sheet parallel to a rolling direction according to JIS Z2244 to determine whether or not ε-Cu was precipitated during coiling. The location of measurement was a middle portion of the sheet in the width and thickness directions. The measurement was performed at freely-selected 10 positions of each of the hot rolled and annealed steel sheets at a load of 300 g, and the maximum value was used as the value of the Vickers hardness of the hot rolled and annealed steel sheet.

Each of the resulting hot rolled and annealed steel sheets was subjected to pickling and cold rolling at a rolling reduction of 60% to provide a cold rolled steel sheet. The cold rolled steel sheet was subjected to finishing annealing in which soaking was performed at 1030° C. for 60 seconds, and pickling to provide a cold rolled and annealed steel sheet having a thickness of 2 mm. Samples and specimens were taken from the resulting cold rolled and annealed steel sheets and used for an oxidation test (continuous oxidation test in air) and a high-temperature fatigue test.

Continuous Oxidation Test in Air

Specimens each having a length of 30 mm and a width of 20 mm were cut out from each of the resulting cold rolled and annealed steel sheets. A hole having a diameter of 4 mm was formed in an upper portion of each of the specimens. Surfaces and end faces of the specimens were polished with 320-grit emery paper. The specimens were hung in a furnace after degreasing. The specimens were held for 200 hours in an air atmosphere heated and held at 1000° C. in the furnace. In this way, a continuous oxidation test in air was performed. The mass of each of the specimens was measured after the test. A difference between a value obtained by the addition of the mass of separated scales to the mass of the specimen and the value of the mass of the specimen measured before the test in advance was determined. The weight gain by oxidation ($g/m^2$) was calculated by dividing the value of the difference by the total surface area of six faces of the specimen (=2×(length×width+length×thickness+width×thickness)). The test was performed with two specimens for each cold rolled and annealed steel sheet. The oxidation resistance was evaluated according to the following evaluation criteria.

○ (Pass): No breakaway oxidation or spalling of the scale occurred in each of the two specimens.

Δ (Fail): No breakaway oxidation occurred in each of the two specimens, and spalling of the scale occurred in one or two of the two specimens.

x (Fail): Breakaway oxidation (weight gain by oxidation ≥100 g/m$^2$) occurred in one or two of the two specimens.

High-Temperature Fatigue Test

Specimens each having a shape illustrated in FIG. 1 were prepared from the cold rolled and annealed steel sheets obtained as described above and used for a high-temperature fatigue test at 850° C. and a high-temperature fatigue test at 700° C. The maximum bending stress on a surface of each specimen was 75 MPa for the test at 850° C. and 110 MPa for the test at 700° C. The specimen was repeatedly subjected to bending at a stress ratio of −1 and a speed of 1300 rpm (=22 Hz). The number of cycles was counted until the specimen was fractured. The stress ratio used here indicates the ratio of the minimum stress to the maximum stress. At a stress ratio of −1, the maximum alternating stress equals the absolute value of the minimum alternating stress. The test was performed twice for each cold rolled and annealed steel sheet and the smaller number of cycles when the specimen was fractured was used for evaluation. The high-temperature fatigue resistance was evaluated according to evaluation criteria as described below.

(1) Evaluation Criteria for High-Temperature Fatigue Test at 850° C.

○ (Pass): The number of cycles ≥10×10$^5$ x (Fail): The number of cycles <10×10$^5$ (2) Evaluation Criteria for High-Temperature Fatigue Test at 700° C.

○ (Pass): The number of cycles ≥22×10$^5$ x (Fail): The number of cycles <22×10$^5$ Table 1 lists the results.

TABLE 1

| Steel | Chemical component (% by mass) | | | | | | | | | | | | |
|---|---|---|---|---|---|---|---|---|---|---|---|---|---|
| No. | C | Si | Mn | P | S | Cr | Al | Cu | Nb | Ti | N | Ni | Others |
| 1 | 0.007 | 0.81 | 0.24 | 0.028 | 0.002 | 15.4 | 0.32 | 1.28 | 0.33 | — | 0.009 | 0.16 | — |
| 2 | 0.003 | 0.72 | 0.12 | 0.031 | 0.003 | 20.9 | 0.49 | 1.41 | 0.59 | — | 0.009 | 0.09 | — |
| 3 | 0.009 | 0.67 | 0.17 | 0.029 | 0.002 | 20.0 | 0.30 | 1.33 | 0.41 | — | 0.009 | — | — |
| 4 | 0.005 | 0.25 | 0.15 | 0.022 | 0.002 | 18.5 | 0.21 | 1.28 | 0.59 | 0.16 | 0.007 | — | — |
| 5 | 0.005 | 0.89 | 0.83 | 0.035 | 0.002 | 16.7 | 0.24 | 1.38 | 0.33 | — | 0.010 | 0.12 | — |
| 6 | 0.008 | 0.95 | 0.14 | 0.032 | 0.002 | 20.5 | 0.89 | 1.25 | 0.36 | 0.17 | 0.010 | 0.14 | — |
| 7 | 0.009 | 0.73 | 0.41 | 0.022 | 0.002 | 19.0 | 0.23 | 1.40 | 0.53 | — | 0.010 | 0.47 | V: 0.04 |
| 8 | 0.005 | 0.47 | 0.23 | 0.022 | 0.003 | 22.8 | 0.24 | 1.06 | 0.60 | 0.20 | 0.007 | — | V: 0.06, B: 0.0004 |
| 9 | 0.005 | 0.97 | 0.47 | 0.039 | 0.002 | 15.8 | 0.49 | 1.95 | 0.38 | 0.17 | 0.008 | — | — |
| 10 | 0.008 | 0.95 | 0.45 | 0.034 | 0.001 | 18.7 | 0.23 | 1.78 | 0.63 | — | 0.010 | — | — |
| 11 | 0.005 | 0.83 | 0.16 | 0.027 | 0.001 | 16.9 | 0.33 | 1.27 | 0.47 | — | 0.008 | 0.14 | V: 0.03, Co: 0.04 |
| 12 | 0.009 | 0.61 | 0.12 | 0.035 | 0.003 | 21.6 | 0.38 | 1.38 | 0.54 | 0.11 | 0.009 | — | Mo: 0.31 |
| 13 | 0.006 | 0.58 | 0.12 | 0.032 | 0.001 | 12.8 | 0.49 | 1.28 | 0.58 | — | 0.006 | — | — |
| 14 | 0.008 | 0.58 | 0.46 | 0.035 | 0.002 | 12.1 | 0.45 | 1.41 | 0.55 | 0.26 | 0.010 | 0.18 | Mo: 0.05, V: 0.05 |
| 15 | 0.010 | 0.68 | 0.30 | 0.030 | 0.002 | 15.7 | 0.33 | 1.24 | 0.37 | — | 0.008 | 0.12 | V: 0.20 |
| 16 | 0.006 | 0.75 | 0.30 | 0.029 | 0.002 | 13.0 | 0.26 | 1.47 | 0.63 | 0.12 | 0.010 | — | Zr: 0.04 |
| 17 | 0.008 | 0.48 | 0.26 | 0.027 | 0.003 | 22.1 | 0.41 | 1.22 | 0.53 | — | 0.008 | 0.23 | Zr: 0.18 |
| 18 | 0.007 | 0.53 | 0.45 | 0.024 | 0.001 | 19.2 | 0.28 | 1.24 | 0.51 | 0.18 | 0.006 | 0.26 | Co: 0.03 |
| 19 | 0.008 | 0.80 | 0.08 | 0.027 | 0.001 | 17.6 | 0.45 | 1.43 | 0.48 | — | 0.006 | — | Co: 0.22 |
| 20 | 0.009 | 0.53 | 0.23 | 0.025 | 0.002 | 14.4 | 0.28 | 1.24 | 0.41 | — | 0.009 | 0.11 | B: 0.0003 |
| 21 | 0.005 | 0.77 | 0.13 | 0.037 | 0.001 | 15.7 | 0.46 | 1.43 | 0.45 | 0.14 | 0.006 | — | B: 0.0014 |
| 22 | 0.006 | 0.64 | 0.20 | 0.028 | 0.002 | 16.8 | 0.51 | 1.50 | 0.40 | — | 0.011 | 0.22 | REM: 0.03 |
| 23 | 0.005 | 0.79 | 0.35 | 0.040 | 0.002 | 20.5 | 0.48 | 1.22 | 0.48 | 0.23 | 0.009 | — | Ca: 0.0004 |
| 24 | 0.010 | 0.98 | 0.29 | 0.021 | 0.003 | 13.2 | 0.26 | 1.34 | 0.30 | — | 0.006 | 0.15 | Mg: 0.0010 |
| 25 | 0.010 | 0.89 | 0.25 | 0.020 | 0.002 | 21.1 | 0.34 | 1.42 | 0.44 | — | 0.007 | 0.21 | V: 0.06, B: 0.0005, Co: 0.04, Ca: 0.0007, Mg: 0.0009 |
| 26 | 0.008 | 0.55 | 0.16 | 0.021 | 0.002 | 21.5 | 0.39 | 1.33 | 0.35 | — | 0.006 | 0.21 | — |
| 27 | 0.010 | 0.52 | 0.09 | 0.024 | 0.002 | 16.2 | 0.35 | 1.16 | 0.53 | — | 0.009 | 0.14 | — |
| 28 | 0.004 | 0.92 | 0.17 | 0.026 | 0.002 | 18.6 | 0.37 | 0.66 | 0.44 | — | 0.008 | 0.15 | — |
| 29 | 0.006 | 0.48 | 0.49 | 0.021 | 0.002 | 17.2 | 0.46 | 2.45 | 0.40 | — | 0.008 | 0.25 | — |
| 30 | 0.006 | 0.61 | 0.41 | 0.037 | 0.003 | 14.0 | 0.28 | 1.39 | 0.47 | 0.18 | 0.007 | — | — |
| 31 | 0.005 | 0.93 | 0.12 | 0.034 | 0.003 | 17.0 | 0.32 | 1.11 | 0.58 | — | 0.009 | 0.08 | — |
| 32 | 0.008 | 0.78 | 0.25 | 0.040 | 0.001 | 19.7 | 0.32 | 1.08 | 0.34 | — | 0.009 | 0.20 | V: 0.05, Co: 0.03 |
| 33 | 0.004 | 0.92 | 0.43 | 0.029 | 0.002 | 16.2 | 0.26 | 1.23 | 0.51 | 0.25 | 0.008 | 0.13 | Ca: 0.0008 |
| 34 | 0.007 | 0.86 | 0.14 | 0.026 | 0.003 | 15.5 | 0.30 | 1.10 | 0.31 | — | 0.009 | 0.29 | — |

| | | | | Cold rolled and annealed steel sheet | | | |
|---|---|---|---|---|---|---|---|
| Steel No. | Si − Al *1 | Coiling temperature (° C.) | Vickers hardness of hot rolled and annealed steel sheet | Oxidation resistance | High-temperature fatigue resistance 850° C. | 700° C. | Remarks |
| 1 | 0.49 | 575 | 176 | ○ | ○ | ○ | Example |
| 2 | 0.23 | 500 | 182 | ○ | ○ | ○ | Example |

TABLE 1-continued

| | | | | | | | |
|---|---|---|---|---|---|---|---|
| 3 | 0.37 | 500 | 179 | ○ | ○ | ○ | Example |
| 4 | 0.04 | 550 | 175 | ○ | ○ | ○ | Example |
| 5 | 0.65 | 450 | 178 | ○ | ○ | ○ | Example |
| 6 | 0.06 | 550 | 186 | ○ | ○ | ○ | Example |
| 7 | 0.50 | 500 | 184 | ○ | ○ | ○ | Example |
| 8 | 0.23 | 550 | 169 | ○ | ○ | ○ | Example |
| 9 | 0.48 | 550 | 198 | ○ | ○ | ○ | Example |
| 10 | 0.72 | 575 | 195 | ○ | ○ | ○ | Example |
| 11 | 0.50 | 575 | 179 | ○ | ○ | ○ | Example |
| 12 | 0.23 | 450 | 179 | ○ | ○ | ○ | Example |
| 13 | 0.09 | 500 | 180 | ○ | ○ | ○ | Example |
| 14 | 0.13 | 575 | 180 | ○ | ○ | ○ | Example |
| 15 | 0.35 | 550 | 177 | ○ | ○ | ○ | Example |
| 16 | 0.49 | 500 | 181 | ○ | ○ | ○ | Example |
| 17 | 0.07 | 550 | 179 | ○ | ○ | ○ | Example |
| 18 | 0.25 | 550 | 178 | ○ | ○ | ○ | Example |
| 19 | 0.35 | 500 | 183 | ○ | ○ | ○ | Example |
| 20 | 0.25 | 450 | 175 | ○ | ○ | ○ | Example |
| 21 | 0.31 | 500 | 182 | ○ | ○ | ○ | Example |
| 22 | 0.13 | 550 | 186 | ○ | ○ | ○ | Example |
| 23 | 0.31 | 450 | 180 | ○ | ○ | ○ | Example |
| 24 | 0.72 | 550 | 183 | ○ | ○ | ○ | Example |
| 25 | 0.55 | 575 | 184 | ○ | ○ | ○ | Example |
| 26 | 0.16 | 625 | 229 | ○ | ○ | x | Comparative example |
| 27 | 0.17 | 650 | 218 | ○ | ○ | x | Comparative example |
| 28 | 0.55 | 500 | 165 | ○ | x | x | Comparative example |
| 29 | 0.02 | 550 | 199 | ○ | ○ | x | Comparative example |
| 30 | 0.33 | 650 | 231 | ○ | ○ | x | Comparative example |
| 31 | 0.61 | 625 | 239 | ○ | ○ | x | Comparative example |
| 32 | 0.46 | 700 | 209 | ○ | ○ | x | Comparative example |
| 33 | 0.66 | 625 | 233 | ○ | ○ | x | Comparative example |
| 34 | 0.56 | 650 | 222 | ○ | ○ | x | Comparative example |

*1 The value obtained by subtracting the content of Al (% by mass) from the content of Si (% by mass).

As is clear from Table 1, in each of the examples (Nos. 1 to 25), the hot rolled and annealed steel sheet had a Vickers hardness less than 205, good oxidation resistance, and good high-temperature fatigue resistance at 700° C. and 850° C. In contrast, in the comparative examples (Nos. 28 and 29) in which the steel compositions were outside our range and the comparative examples (Nos. 26, 27, and 30 to 34) in which the hot rolled and annealed steel sheets each had a Vickers hardness of 205 or more, the high-temperature fatigue resistance at 700° C. was poor.

INDUSTRIAL APPLICABILITY

The hot rolled and annealed ferritic stainless steel sheet and the cold rolled and annealed ferritic stainless steel sheet are suitably used for exhaust parts for automobiles and so forth, the exhaust parts being used at high temperatures, and also suitably used for exhaust parts for thermal electric power plants and members for solid oxide fuel cells, which are required to have similar characteristics.

The invention claimed is:

1. A hot rolled and annealed ferritic stainless steel sheet comprising:

a composition that consists of, on a mass percent basis, 0.015% or less of C, 1.00% or less of Si, 0.50% or less of Mn, 0.040% or less of P, 0.010% or less of S, 12.0% or more and 23.0% or less of Cr, 0.20% or more and 1.00% or less of Al, 0.020% or less of N, 1.03% or more and 1.81% or less of Cu, 0.35% or more and 0.65% or less of Nb, and optionally, on a mass percent basis, 0.50% or less of Ti, 0.50% or less of Zr, 0.50% or less of V, 0.0030% or less of B, 0.08% or less of REM, 0.0050% or less of Ca, 0.0050% or less of Mg, 0.50% or less of Ni, and 0.50% or less of Co, Si and Al being contained so as to satisfy expression (1) described below, the balance being Fe and incidental impurities, and the hot rolled and annealed ferritic stainless steel sheet having a Vickers hardness less than 205, a high-temperature fatigue resistance at 850° C. of greater than or equal to $10\times10^5$ cycles, and a high-temperature fatigue resistance at 700° C. of greater than or equal to $22\times10^5$ cycles, $$Si \geq Al \quad (1)$$

(where in expression (1), Si represents the content of Si (% by mass), and Al represents the content of Al (% by mass)).

2. The hot rolled and annealed ferritic stainless steel sheet according to claim 1, further containing, on a mass percent basis, one or two or more selected from 0.50% or less of Ti, 0.50% or less of Zr, 0.50% or less of V, 0.0030% or less of B, 0.08% or less of REM, 0.0050% or less of Ca, and 0.0050% or less of Mg, in addition to the composition.

3. A cold rolled and annealed ferritic stainless steel sheet produced by subjecting the hot rolled and annealed ferritic stainless steel sheet according to claim 1 to cold rolling and annealing treatment.

4. A cold rolled and annealed ferritic stainless steel sheet produced by subjecting the hot rolled and annealed ferritic stainless steel sheet according to claim 2 to cold rolling and annealing treatment.

5. A method for producing the hot rolled and annealed ferritic stainless steel sheet according to claim 1, the method comprising:

subjecting a steel slab to hot rolling and hot rolled steel sheet annealing in that order, wherein in the hot rolling, a coiling temperature is lower than 600° C.

6. A method for producing the hot rolled and annealed ferritic stainless steel sheet according to claim 2, the method comprising:

subjecting a steel slab to hot rolling and hot rolled steel sheet annealing in that order, wherein, in the hot rolling, a coiling temperature is lower than 600° C.

* * * * *